US006727208B2

(12) United States Patent
Wilk

(10) Patent No.: US 6,727,208 B2
(45) Date of Patent: Apr. 27, 2004

(54) LUBRICANTS CONTAINING A BIMETALLIC DETERGENT SYSTEM AND A METHOD OF REDUCING $NO_X$ EMISSIONS EMPLOYING SAME

(75) Inventor: Melody A. Wilk, Timberlake, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 24 days.

(21) Appl. No.: 10/148,093

(22) PCT Filed: Dec. 15, 2000

(86) PCT No.: PCT/US00/33703

§ 371 (c)(1),
(2), (4) Date: May 23, 2002

(87) PCT Pub. No.: WO01/44419

PCT Pub. Date: Jun. 21, 2001

(65) Prior Publication Data

US 2003/0013620 A1 Jan. 16, 2003

(51) Int. Cl.[7] ..... C10M 159/24

(52) U.S. Cl. ..... 508/291; 508/293; 508/294; 508/372; 508/373; 508/379; 508/391; 508/399

(58) Field of Search ..... 508/287, 291, 508/372, 373

(56) References Cited

U.S. PATENT DOCUMENTS

| | | | | | |
|---|---|---|---|---|---|
| 4,283,294 | A | | 8/1981 | Clarke | 252/32.7 |
| 4,326,972 | A | | 4/1982 | Chamberlin, III | 252/33.3 |
| 4,952,328 | A | | 8/1990 | Davis et al. | 252/32.7 |
| 5,256,322 | A | | 10/1993 | Cohu | 252/33.2 |
| 5,562,864 | A | | 10/1996 | Salomon et al. | 508/232 |
| 5,726,133 | A | | 3/1998 | Blahey et al. | 508/390 |
| 5,767,045 | A | * | 6/1998 | Ryan | 508/287 |
| 5,804,537 | A | | 9/1998 | Boffa et al. | 508/398 |
| 5,958,848 | A | * | 9/1999 | Robson | 508/232 |
| 6,060,437 | A | * | 5/2000 | Robson et al. | 508/371 |
| 6,306,801 | B1 | * | 10/2001 | Yagishita et al. | 508/292 |
| 6,323,162 | B1 | * | 11/2001 | Yasunori et al. | 508/192 |
| 6,569,819 | B2 | * | 5/2003 | Yagishita et al. | 508/291 |

FOREIGN PATENT DOCUMENTS

| | | | |
|---|---|---|---|
| EP | 859 042 A1 | 8/1987 | 129/93 |
| EP | 731 159 A2 | 9/1996 | 159/20 |
| WO | 87/01722 | 3/1987 | |

* cited by examiner

*Primary Examiner*—Ellen M. McAvoy
(74) *Attorney, Agent, or Firm*—David M. Shold; Michael F. Esposito

(57) ABSTRACT

A lubricating oil composition comprising a major amount of an oil of lubricating viscosity and an additive system comprising (A) from about 0.1 to about 5% by weight of a detergent composition comprising at least two metal overbased compositions wherein said detergent composition consists essentially of (A-1) at least one alkali metal overbased detergent and (A-2) at least one calcium overbased detergent, wherein the ratio of total base number on a per 100 TBN and diluent-free basis contributed by the alkali metal detergent to the total base number contributed by the calcium detergent ranges from about 99.5–20 to about 0.5–80; (B) from about 1 to about 10% by weight of a succinimide dispersant; and (C) from about 0.1 to about 5 % by weight of a metal dihydrocarbyl dithiophosphate of the formula (I) wherein $R^1$ and $R^2$ are each, independently, hydrocarbyl groups containing from 3 to 13 carbon atoms, M is a metal and n is an integer equal to the valence of M. Also disclosed are methods for cleaning the combustion chamber of internal combustion engines, a method for reducing fuel consumption of internal combustion engines and a method for reducing $NO_x$ emissions of internal combustion engines.

10 Claims, No Drawings

LUBRICANTS CONTAINING A BIMETALLIC DETERGENT SYSTEM AND A METHOD OF REDUCING $NO_x$ EMISSIONS EMPLOYING SAME

FIELD OF THE INVENTION

This invention relates generally to lubricating oil compositions and methods of reducing exhaust emissions, reducing fuel consumption and cleaning combustion chambers of internal combustion engines.

BACKGROUND OF THE INVENTION

The International Lubricant Standardization and Approval Committee (ILSAC) GF-2 specification requires passenger car motor oils to provide enhanced fuel economy in a modern low friction engine (ASTM Sequence VI-A). Previous investigations have indicated that the choice of detergent system and friction modifier used in a motor oil has a large impact on the fuel economy of the lubricant. Further studies indicate that detergent systems can affect tailpipe emissions.

Emissions from internal combustion engines are the primary cause of air pollution in many cities and metropolitan areas. Such emissions include uncombusted hydrocarbons, hydrocarbons formed in the combustion process, sulfur oxides, nitrogen oxides, and particulate matter. To attempt to reduce the quantities of these emissions, the federal and state governments have imposed emission standards. These standards typically apply to new engines but have also been applied on a fleet-average basis to include previously manufactured engines in the emission reduction strategy. Over time, the standards have required lower and lower levels of emissions. New standards have been proposed that will further significantly reduce the level of emissions that will be permitted. There have, accordingly, been many and diverse attempts to reduce the levels of emissions, both of newly manufactured engines and of previously manufactured engines, through modification and add-on equipment programs.

A fundamentally sound way to reduce the level of vehicle emissions is by reducing the amount of fuel consumed during operation.

Hydrocarbon emissions are undesirable because of the role they play in air pollution and also because they represent an energy loss from that available in the hydrocarbon fuel. Sulfur oxides not only contribute to local air pollution, but also are the principal cause of acid rain. Urban smog is caused primarily by nitrogen oxides ($NO_x$). The black smoke of engine exhaust is typically caused by particulate emissions which add to the local air pollution and may cause health problems, including cancer, known to be caused by the polycyclic aromatic compounds in the solvent organic fraction of the particulates.

The levels of emissions of an engine are interrelated by complex and poorly understood mechanisms. It is known, for example, that adding anhydrous alcohol to gasoline reduces the hydrocarbon content of the fuel, and also tends to reduce the levels of emitted particulates and carbon monoxide. Increasing the temperature of the in-cylinder combustion usually results in more complete combustion of the fuel, reducing hydrocarbon emissions, but also results in increased nitrogen oxides and affects the polycyclic aromatic hydrocarbon constituents of the particulates. Sulfur oxide emissions can be reduced by using low sulfur fuels, but it is known that reducing sulfur in the fuel normally changes the aromatics and boiling range of the fuel, both of which affect the amount of particulates emitted.

As noted above, at the same time, improved fuel economy is required.

U.S. Pat. No. 4,326,972 (Chamberlin, Ill, Apr. 27, 1982) relates to fuel economy of internal combustion engines, especially gasoline engines, which is improved by lubricating such engines with specific lubricant compositions in which the essential ingredients are a specific sulfurized composition and a basic alkali metal sulfonate. Additional ingredients may include at least one oil-dispersible detergent or dispersant, a viscosity improving agent, and a specific salt of a phosphorus acid.

U.S. Pat. No. 4,952,328 (Davis et al., Aug. 28, 1990) describes a lubricating oil formulation which is useful in internal combustion engines. More particularly, lubricating oil compositions for internal combustion engines are described which comprise (A) at least about 60% by weight of oil of lubricating viscosity, (B) at least about 2.0% by weight of at least one carboxylic derivative composition produced by reacting (B-1) at least one substituted succinic acylating agent with (B-2) from about 0.70 equivalent up to less than one equivalent, per equivalent of acylating agent, of at least one amine compound characterized by the presence within its structure of at lest one HN<group, and wherein said substituted succinic acylating agent consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of about 1.5 to about 4.5, said acylating agents being characterized by the presence within their structure of an average of at least 1.3 succinic groups for each equivalent weight of substituent groups, and (C) from about 0.01 to about 2% by weight of at least one basic alkali metal salt of sulfonic or carboxylic acid. The oil compositions of the invention also may contain (D) at least one metal dihydrocarbyl dithiophosphate and/or (E) at least one carboxylic ester derivative composition, and/or (F) at least one partial fatty acid ester of a polyhydric alcohol, and/or (G) at least one neutral or basic alkaline earth metal salt of at least one acidic organic compound. In one embodiment, the oil compositions of the present invention contain the above additives and other additives described in this specification in amounts sufficient to enable the oil to meet all the performance requirements of API Service Classification SG.

U.S. Pat. No. 5,256,322 (Cohu, Oct. 26, 1993) relates to a lubricating oil for use in methanol fueled internal combustion engines, the lubricating oil having a total base number from 9.0 to about 14.0 and comprising:

a) a suitable base oil;

b) overbased sodium-sulfonate in an amount sufficient to provide a base number from about 1.0 to about 2.0 in said lubricating oil; and c) at least one metal sulfonate selected from the group consisting of overbased calcium sulfonate, overbased magnesium sulfonate and mixtures thereof in an amount sufficient to provide a base number from about 8.0 to about 12.0 in said lubricating oil.

U.S. Pat. No. 5,562,864 (Salomon et al., Oct. 8, 1996) describes a lubricating oil composition which comprises a major amount of an oil of lubricating viscosity and (A) at least about 1% by weight of at least one carboxylic derivative composition produced by reacting (A-1) at least one substituted succinic acylating agent containing at least about 50 carbon atoms in the substituent with (A-2) from about 0.5 equivalent up to about 2 moles, per equivalent of acylating agent (A-1), of at least one amine compound characterized by the presence within its structure of at least one HN<group; and (B) an amount of at least one alkali metal overbased salt of a carboxylic acid or a mixture of a carboxylic acid and an organic sulfonic acid sufficient to provide at least about 0.002 equivalent of alkali metal per 100 grams of the lubricating oil composition provided that when the alkali metal salt comprises a mixture of overbased alkali metal salts of a hydrocarbyl-substituted carboxylic acid and a hydrocarbyl-substituted sulfonic acid, then the carboxylic acid comprises more than 50% of the acid equivalents of the mixture; and either (C-1) at least one magnesium overbased salt of an acidic organic compound provided that the lubricating composition is free of calcium overbased salts of acidic organic compounds; or (C-2) at least one calcium overbased salt of an acidic organic compound provided that the lubricating composition is free of magnesium overbased salts of acidic organic compounds.

U.S. Pat. No. 5,726,133 (Blahey et al., Mar. 10, 1998) is directed to a low ash natural gas engine oil which contains an additive package including a particular combination of detergents and also containing other standard additives such as dispersants, antioxidants, antiwear agents, metal deactivators, antifoamants and pour point depressants and viscosity index improvers. The low ash natural gas engine oil exhibits reduced deposit formation and enhanced resistance to oil oxidation and nitration.

U.S. Pat. No. 5,804,537 (Boffa et al., Sep. 8, 1998) relates to a low phosphorus passenger car motor oil containing an oil of lubricating viscosity as the major component and a tri-metal detergent mixture as a minor component, wherein the tri-metal detergent mixture comprises at least one calcium overbased metal detergent, at least one magnesium overbased metal detergent and at least one sodium overbased metal detergent, wherein the tri-metal detergent mixture is present in the oil composition in an amount such that the total TBN contributed to the oil composition by the tri-metal detergent mixture is from about 2 to about 12, and wherein the calcium overbased detergent contributes from about 8 to about 42% of the total TBN contributed by the tri-metal detergent mixture, the magnesium overbased detergent contributes from about 29 to about 60% of the total TBN contributed by the tri-metal detergent mixture, and the sodium overbased detergent contributes from about 15 to about 64% of the total TBN contributed by the tri-metal detergent mixture.

SUMMARY OF THE INVENTION

This invention is directed to a lubricating oil composition comprising a major amount of an oil of lubricating viscosity and an additive system comprising (A) from about 0.1 to about 5% by weight of a detergent composition, comprising at least two metal overbased compositions wherein said detergent composition consists essentially of (A-1) at least one alkali metal overbased detergent and (A-2) at least one calcium overbased detergent, wherein the ratio of total base number on a per 100 TBN and diluent-free basis contributed by the alkali metal detergent to the total base number contributed by the calcium detergent ranges from about (99.5–20) to about (0.5–80);

(B) from about 1 to about 10% by weight of a succinimide dispersant; and (C) from about 0.1 to about 5% by weight of a metal dihydrocarbyl dithiophosphate of the formula

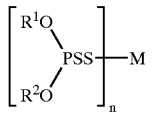

wherein $R^1$ and $R^2$ are each, independently, hydrocarbyl groups containing from 3 to 13 carbon atoms, M is a metal and n is an integer equal to the valence of M.

Also included are methods for reducing fuel consumption and exhaust emissions of internal combustion engines and methods for cleaning the combustion chamber thereof.

DETAILED DESCRIPTION OF THE INVENTION

In the method of this invention, the combustion chamber of an internal combustion engine is cleaned utilizing a $NO_x$ emission-reducing amount of a lubricating oil composition comprising components (A), (B), and (C). Within this invention, the words "cleaned", "clean" or "cleaning" signify removal of particulate solids from the combustion chamber in the case of a combustion chamber that contains deposits and/or the prevention or reduction of particulate solids build-up in the combustion chamber. The lubricating compositions of this invention also provide a fuel-economy improving benefit.

As used herein, the terms hydrocarbyl substituent, hydrocarbyl group, hydrocarbon group, and the like, are used to refer to a group having one or more carbon atoms directly attached to the remainder of a molecule and having a hydrocarbon or predominantly hydrocarbon character. Examples include:

(1) purely hydrocarbon groups, that is, aliphatic (e.g., alkyl, alkenyl or alkylene), alicyclic (e.g., cycloalkyl, cycloalkenyl) groups, aromatic groups, and aromatic-, aliphatic-, and alicyclic-substituted aromatic groups, as well as cyclic groups wherein the ring is completed through another portion of the molecule;

(2) substituted hydrocarbon groups, that is, hydrocarbon groups containing non-hydrocarbon groups which, in the context of this invention, do not alter the predominantly hydrocarbon nature of the group (e.g., halo, hydroxy, alkoxy, mercapto, alkylmercapto, nitro, nitroso, and sulfoxy);

(3) hetero substituted hydrocarbon groups, that is, hydrocarbon groups containing substituents which, while having a predominantly hydrocarbon character, in the context of this invention, contain other than carbon in a ring or chain otherwise composed of carbon atoms. Heteroatoms include sulfur, oxygen, nitrogen. In general, no more than two, and in one embodiment no more than one, non-hydrocarbon substituent is present for every ten carbon atoms in the hydrocarbon group.

In general, no more than about three nonhydrocarbon groups or heteroatoms and preferably no more than one, will be present for each ten carbon atoms in a hydrocarbyl group. Typically, there will be no such groups or heteroatoms in a hydrocarbyl group and it will, therefore, be purely hydrocarbyl.

The hydrocarbyl groups are preferably free from acetylenic unsaturation. Ethylenic unsaturation, when present will generally be such that there is no more than one ethylenic linkage present for every ten carbon-to-carbon bonds. The hydrocarbyl groups are often completely saturated and therefore contain no ethylenic unsaturation.

The term "lower" as used herein in conjunction with terms such as hydrocarbyl, alkyl, alkenyl, alkoxy, and the like, is intended to describe such groups which contain a total of up to 7 carbon atoms.

As used herein, the expression "consisting essentially of" permits the inclusion of substances which do not materially affect the basic and novel characteristics of the composition under consideration. Accordingly, the expressions "consists essentially of" or "consisting essentially of" mean that the recited embodiment, feature, component, etc. must be present and that other embodiments, features, components, etc., may be present provided the presence thereof does not materially affect the performance, character or effect of the recited embodiment, feature, component, etc. The presence of impurities or a small amount of a material that has no material effect on a composition is permitted. Also, the intentional inclusion of small amounts of one or more non-recited components that otherwise have no material effect on the character or performance of a composition is still included within the definition of "consisting essentially of".

The expression "total base number" (TBN) refers to a measure of the amount of acid (perchloric or hydrochloric) needed to neutralize the basicity of a product or a composition, expressed as milligrams KOH/gram of sample. It is measured using Test Method ASTM D-2896.

Oil of Lubricating Viscosity

The lubricating compositions of this invention employ an oil of lubricating viscosity, including natural or synthetic lubricating oils and mixtures thereof. Mixtures of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins, etc. and mixtures thereof, alkylbenzenes, polyphenyl, (e.g., biphenyls, terphenyls, alkylated polyphenyls, etc.), alkylated diphenyl ethers and alkylated diphenyl sulfides and their derivatives, analogs and homologues thereof and the like.

Alkylene oxide polymers and interpolymers and derivatives thereof, and those where terminal hydroxyl groups have been modified by esterification, etherification, etc., constitute other classes of known synthetic lubricating oils that can be used.

Another suitable class of synthetic lubricating oils that can be used comprises the esters of dicarboxylic acids and those made from $C_5$ to $C_{12}$ monocarboxylic acids and polyols or polyether polyols.

Other synthetic lubricating oils include liquid esters of phosphorus-containing acids, polymeric tetrahydrofurans, alkylated diphenyloxides and the like.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

Specific examples of the above-described oils of lubricating viscosity are given in Chamberlin III, U.S. Pat. No. 4,326,972 and European Patent Publication 107,282, both of which are hereby incorporated herein by reference for relevant disclosures contained therein.

A basic, brief description of lubricant base oils appears in an article by D. V. Brock, "Lubrication Engineering", Volume 43, pages 184–5, March, 1987, which article is expressly incorporated by reference for relevant disclosures contained therein.

(A) The Detergent

At least two metal overbased detergent compositions are present as (A-1) and (A-2). Component (A-1) is at least one alkali metal overbased detergent and (A-2) is at least one calcium overbased detergent. Overbased detergents used in this invention are prepared by reacting a metal oxide or metal hydroxide with a substrate and carbon dioxide gas. The substrate is usually an acid, usually an acid selected from the group consisting of aliphatic substituted sulfonic acids, aliphatic substituted carboxylic acids and aliphatic substituted phenols. The alkali metals comprise at least one of lithium and sodium with sodium being preferred.

While an alkali metal overbased detergent and a calcium metal overbased detergent are both present, they are usually present as separately overbased compositions. That is, an alkali metal overbased composition and a calcium overbased composition are separately prepared then incorporated into the lubricating oil composition. Two separate metal overbased compositions are used. However, an acid simultaneously overbased with both sodium and calcium containing reagents is also useful in the instant invention.

The terminology "overbased", relates to metal salts (sulfonates, carboxylates and phenates) wherein the amount of metal present exceeds the stoichiometric amount. Such salts are said to have conversion levels in excess of 100% (i.e., they comprise more than 100% of the theoretical amount of metal needed to convert the acid to its "normal", "neutral" salt). The expression "metal ratio", often abbreviated as MR, is used in the prior art and herein to designate the ratio of total chemical equivalents of metal in the overbased salt to chemical equivalents of the metal in a neutral salt according to known chemical reactivity and stoichiometry. Thus, in a normal or neutral salt, the metal ratio is one and in an overbased salt MR is greater than one. They are commonly referred to as overbased, hyperbased or superbased salts and are usually salts of organic sulfur acids, carboxylic acids, or phenols.

The alkali metal overbased detergent typically has a metal ratio of at least 10:1, preferably at least 13:1 and most preferably at least 16:1. The calcium overbased detergent typically has a metal ratio of at least 10:1, preferably at least 12:1 and more preferably at least 20:1.

Sulfonic acids include the mono- or poly-nuclear aromatic or cycloaliphatic compounds which, when overbased, are called sulfonates. The oil-soluble sulfonates can be represented for the most part by the following formulae:

$$[R^3)_x—T—(SO_3)_y]_zM_f \quad (I)$$

$$[R^4(SO_3)_g]_hM_i \quad (II)$$

In the above formulae, M is a metal cation as described hereinabove; T is a cyclic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydro-naphthalene, cyclopentane, etc.; $R^3$ in Formula I is an aliphatic group such as alkyl, alkenyl, alkoxy, alkoxyalkyl, carboalkoxyalkyl, etc.; x is at least 1, and $(R^3)_x$+T contains a total of at least 15 carbon atoms, $R^4$ in Formula II is an aliphatic group containing at least about 9, preferably at least about 12 and often at least about 15 carbon atoms and M is a metal cation. Examples of type of the $R^4$ radical are alkyl, alkenyl, alkoxyalkyl, carboalkoxyalkyl, etc. Specific examples of $R^4$ are groups derived from petrolatum, saturated and unsaturated paraffin wax, and polyolefins, including polymerized $C_2$, $C_3$, $C_4$, $C_5$, $C_6$, etc., olefins containing up to about 7000 carbon atoms in the polymer. The groups T, $R^3$, and $R^4$ in the above formulae can also contain other inorganic or organic substituents in addition to those enumerated above such as, for example, hydroxy, mercapto, halogen, nitro, amino, nitroso, sulfide, disulfide, etc. In the above Formulae I and II, each of x, y, z and f and g, i, and h is at least 1.

Specific examples of sulfonic acids useful in this invention are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax substituted sulfonic and polysulfonic acids of, e.g., benzene, naphthalene, phenol, diphenyl ether, naphthalene disulfide, diphenylamine, thiophene, alpha-chloronaphthalene, etc.; other substituted sulfonic acids such as alkyl benzene sulfonic acids (where the alkyl group has at least 8 carbons), cetylphenol mono-sulfide sulfonic acids, dicetyl thianthrene disulfonic acids, dilauryl beta naphthyl sulfonic acid, dicapryl nitronaphthalene sulfonic acids, and alkaryl sulfonic acids such as dodecyl benzene "bottoms" sulfonic acids.

The bottoms acids are derived from benzene which has been alkylated with propylene tetramers or isobutene trimers to introduce 1,2,3, or more branched-chain $C_{12}$ substituents on the benzene ring. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture-by-products by reaction with, e.g., $SO_3$, is well known to those skilled in the art. See, for example, the articles "Sulfonation and Sulfation", Vol. 23, pp. 146 at seq. and "Sulfonic Acids", Vol. 23, pp. 194 et seq, both in Kirk-Othmer "Encyclopedia of Chemical Technology", Fourth Edition, published by John Wiley & Sons, N.Y. (1997).

Also included are aliphatic sulfonic acids containing at least about 7 carbon atoms, often at least about 12 carbon atoms in the aliphatic group, such as paraffin wax sulfonic acids, unsaturated paraffin wax sulfonic acids, hydroxy-substituted paraffin wax sulfonic acids, hexapropylene sulfonic acids, tetra-amylene sulfonic acids, polyisobutene sulfonic acids wherein the polyisobutene contains from 20 to 7000 or more carbon atoms, chloro-substituted paraffin wax sulfonic acids, nitroparaffin wax sulfonic acids, etc.; cycloaliphatic sulfonic acids such as petroleum naphthene sulfonic acids, cetyl cyclopentyl sulfonic acids, lauryl cyclohexyl sulfonic acids, bis-(di-isobutyl) cyclohexyl sulfonic acids, etc.

With respect to the sulfonic acids or salts thereof described herein and in the appended claims, it is intended that the term "petroleum sulfonic acids" or "petroleum sulfonates" includes all sulfonic acids or the salts thereof derived from petroleum products. A particularly valuable group of petroleum sulfonic acids are the mahogany sulfonic acids (so called because of their reddish-brown color) obtained as a by-product from the manufacture of petroleum white oils by a sulfonic acid process.

Other descriptions of overbased sulfonate salts and techniques for making them can be found in the following U.S. Pat. Nos. 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,297; 2,315,514; 2,319,121; 2,321,022; 2,333,568; 2,333,788; 2,335,259; 2,337,552; 2,346,568; 2,366,027; 2,374,193; 2,383,319; 3,312,618; 3,471,403; 3,488,284; 3,595,790; and 3,798,012. These are hereby incorporated by reference for their disclosures in this regard.

Carboxylic acids from which suitable alkali and calcium overbased detergents for use in this invention can be made include aliphatic mono- and polybasic carboxylic acids. The aliphatic carboxylic acids generally contain at least 9 carbon atoms, often at least 15 carbon atoms and preferably at least 18 carbon atoms. Usually, they have no more than 400 carbon atoms. Generally, if the aliphatic carbon chain is branched, the acids are more oil-soluble for any given carbon atoms content. The aliphatic carboxylic acids can be saturated or unsaturated. Specific examples include linolenic acid, linoleic acid, behenic acid, isostearic acid, stearic acid, palmitoleic acid, lauric acid, oleic acid, ricinoleic acid, commercially available mixtures of two or more carboxylic acids, such as tall oil acids, rosin acids, and the like.

Preferred aliphatic carboxylic acids are of the formula

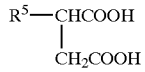

wherein $R^5$ is an aliphatic hydrocarbon-based group of at least 7 carbon atoms, often at least 12 carbon atoms and preferably, at least 15 carbon atoms, and not more than about 400 carbon atoms, and reactive equivalents thereof.

In another embodiment, the carboxylic acid is a hydrocarbyl-substituted carboxyalkylene-linked phenol; dihydrocarbyl ester of alkylene dicarboxylic acids, the alkylene group being substituted with a hydroxy group and an additional carboxylic acid group; alkylene-linked polyaromatic molecules, the aromatic moieties whereof comprise at least one hydrocarbyl-substituted phenol and at least one carboxy phenol; and hydrocarbyl-substituted carboxyalkylene-linked phenols.

These carboxylic compounds are prepared by reacting a phenolic reagent with a carboxylic reagent of the general formula $$R^1CO(CR^2R^3)_xCOOR^6$$

wherein $R^1$, $R^2$ and $R^3$ are independently H or a hydrocarbyl group, $R^6$ is H or an alkyl group, and x is an integer ranging from 0 to about and reactive equivalents thereof. Compounds of this type are described in several U.S. Patents including numbers U.S. Pat. Nos. 5,281,346; 5,336,278 AND 5,356,546.

Unsaturated hydroxycarboxylic compounds prepared by reacting olefinic compounds with this carboxylic compound are also useful. Compounds of this type are described in several U.S. Patents including U.S. Pat. Nos. 5,696,060; 5,696,067; 5,777,142 and 6,020,500.

Aromatic carboxylic acids are useful for preparing metal salts useful in the compositions of this invention. These include aromatic carboxylic acids such as hydrocarbyl substituted benzoic, phthalic and salicylic acids.

Salicylic acids and other aromatic carboxylic-acids are well known or can be prepared according to procedures known in the art. Carboxylic acids of this type and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791. These patents are incorporated by reference for disclosure of carboxylic acids, their basic salts and processes of making the same.

In the context of this invention, phenols are considered organic acids. Thus, overbased salts of phenols (generally known as phenates) are also useful in making (A) of this invention and are well known to those skilled in the art.

A commonly available class of phenates are those made from phenols of the general formula

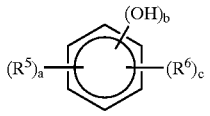

wherein $R^5$ is as described hereinabove, $R^6$ is a lower aliphatic of from 1 to 6 carbon atoms, a is an integer of from 1 to 3, b is 1 or 2 and c is 0 or 1.

One particular class of phenates for use in this invention are the overbased phenates made by sulfurizing a phenol as described hereinabove with a sulfurizing agent such as sulfur, a sulfur halide or sulfide or hydrosulfide salt. Techniques for making sulfurized phenates are described in U.S. Pat. Nos. 2,680,096; 3,036,971; and 3,775,321 which are expressly incorporated herein by reference for their disclosures in this regard.

Other phenates that are useful are those that are made from phenols that have been linked through alkylene (e.g., methylene) bridges. These are made by reacting single or multi-ring phenols with aldehydes or ketones, typically in the presence of an acid or basic catalyst. Such linked phenates, as well as sulfurized phenates, are described in detail in U.S. Pat. No. 3,350,038; particularly columns 6–8, thereof which is expressly incorporated herein by reference for its disclosure in this regard.

Salicylic acids may be considered to be carboxylic acids or phenols. Hydrocarbyl substituted salicylic acids are useful for preparing metal salts useful in the compositions of this invention.

Preferred overbased metal salts are the hydrocarbyl substituted sulfonic acid salts.

The alkali metal and calcium overbased salts are present in the compositions used in this invention in relative amounts on a per 100 TBN and diluent free basis ranging from about (99.5–20) to about (0.5–80), preferably from about (99.5–40) to about (0.5–60), more preferably from about (99–45) to about (1–55) and most preferably from about (98–50) to about (2–50).

The following specific illustrative examples describe how to make alkali metal overbased detergents (A-1) and calcium overbased detergents (A-2). In these examples and in subsequent sets of example, as well as in this specification and the appended claims, all percentages, parts and ratios are by weight and temperatures are in degrees Celsius (° C.) unless expressly stated otherwise. Filtrations are conducted using a diatomaceous earth filter aid.

EXAMPLE (A)-1

A flask is charged with 835 parts oil, 118 parts of polyisobutenyl (molecular weight of 1000) substituted succinic anhydride having a saponification number of 100, a solution of 5.9 parts calcium chloride dissolved in 37 parts water, and 118 parts of a mixture of alcohols comprising 61% isobutyl alcohol, 25.5% 2-methyl-1-butanol and 25.5% primary amyl alcohol. To the stirred contents are stirred are added 93 parts calcium hydroxide. An alkyl benzene sulfonic acid (1000 parts, 1.8 equivalents) is added at a rate which maintains the temperature below 80° C. while stirring is continued. Volatiles are removed at 150° C. and the contents are cooled to about 50° C. At this temperature are added 127 parts of the aforedescribed mixed alcohols, 277 parts methyl alcohol and 88 parts of a 31% in oil solution of a methylene coupled alkylated calcium phenate. The first of three calcium hydroxide additions, 171 parts per addition, is added and the contents are carbonated to a direct base number of 50–60. The fourth addition of 171 parts calcium hydroxide is added and the contents are carbonated to a direct base number of 45–55. Volatiles are removed at 150° C. and the contents are filtered to give a product containing 41% oil, 300 total base number, metal ratio of 11.0, 40.7% calcium sulfate ash and 1.8% sulfur.

EXAMPLE (A)-2

A sodium overbased sulfonic acid is prepared by adding 121 parts of the polyisobutenyl succinic anhydride of Example (A)-1, 583 parts diluent oil, 84 parts of a tetrapropene-substituted phenol and 417 parts (0.83 equivalents) of an alkyl benzene sulfonic acid to a reaction vessel. The contents are heated and stirred to 49° C. and 102 parts of a 50% aqueous solution of sodium hydroxide are added, allowing the temperature to rise to 82° C. The temperature is then increased to 86° C. and held at this temperature for one hour. Four increments of 184 parts (4.61 equivalents) of sodium hydroxide beads are added and each increment is followed with carbon dioxide blowing at 150° C. until 103 parts carbon dioxide is absorbed. Diluent oil, 35 parts, is added and the contents are filtered to give a product containing 31% oil, 448 total base number, metal ratio of 23.0, 19.45% sodium and 1.2% sulfur.

EXAMPLE (A)-3

A reactor is charged with 470 parts diluent oil, 92 parts of the polyisobutenyl succinic anhydride of Example (A)-1, 23 parts acetic acid, 24 parts water and 92 parts (2.5 equivalents) of calcium hydroxide. After stirring for 0.1 hour, 109 parts of the mixture of alcohols of Example (A)-1 are added followed by 1000 parts (1.4 equivalents) of an alkyl benzene sulfonic acid. The sulfonic acid is added at a rate to maintain the temperature at 75° C. The contents are stripped of volatiles by heating to 150° C. At 49° C., then an additional 109 parts of the mixture of alcohols, 69 parts of the alkylated calcium phenate of Example (A)-1 and 216 parts of methyl alcohol. Four increments of 137 parts each (3.7 equivalents) of calcium hydroxide are added and each increment is followed with carbon dioxide blowing at about 62° C. The contents are stripped of volatiles at 146° C., 292 parts oil is added and the contents are filtered to give a product having 42% oil, 300 total base number, 12% calcium, metal ratio of 11.0 and 1.78% sulfur.

EXAMPLE (A)-4

Add to a flask about 512 parts by weight of a mineral oil solution containing about 0.5 equivalent of a substantially neutral magnesium salt of an alkylated salicylic acid wherein the alkyl group has an average of about 18 aliphatic carbon atoms, about 30 parts by weight of an oil mixture containing about 0.037 equivalent of an alkylated benzenesulfonic acid together with about 15 parts by weight (0.65 equivalents) of magnesium oxide and about 250 parts by weight of xylene. Heat to a temperature of about 60° C. to 70° C. Increase the heat to about 85° C. and add approximately 60 parts by weight of water. Hold the reaction mass at a reflux temperature of about 95° C. to 100° C. for about 1 ½ hours and subsequently strip at a temperature of 155–160° C., under a vacuum, and filter. The filtrate will comprise the basic carboxylic magnesium salt containing 200% of the stoichiometrically equivalent amount of magnesium.

EXAMPLE (A)-5

Prepare a substantially neutral magnesium salt of an alkylated salicylic acid wherein the alkyl groups have from 16 to 24 aliphatic carbon atoms by reacting approximately stoichiometric amounts of magnesium chloride with a substantially neutral potassium salt of the alkylated salicylic acid. Charge a flask with a reaction mass comprising approximately 6580 parts by weight of a mineral oil solution containing about 6.50 equivalents of the substantially neutral magnesium salt of the alkylated salicylic acid and about 388 parts by weight of an oil mixture containing about 0.48 equivalent of an alkylated benzenesulfonic acid together with approximately 285 parts by weight (14 equivalents) of magnesium oxide and approximately 3252 parts by weight of xylene. Heat to a temperature of about 55° C. to 75° C. Increase the temperature to about 82° C. and add approximately 780 parts by weight of water to the reaction and then heat to the reflux temperature. Hold the reaction mass at the reflux temperature of about 95–100° C. for about one hour and subsequently strip at a temperature of about 170° C., under 50 torr and filter. The filtrate will comprise the basic carboxylic magnesium salts and have a sulfated ash content of 15.7% (sulfated ash) corresponding to 276% of the stoichiometrically equivalent amount.

EXAMPLE (A)-6

A reaction mixture comprising 2900 grams (3 equivalents) of an oil solution of the magnesium salt of polyisobutylene (average molecular weight-480)-substituted salicylic acids, 624 grams of mineral oil, 277 grams (1 equivalent) of a commercial mixture of tall oil acids, 1800 grams of xylene, 195 grams (9 equivalents) of magnesium oxide, and 480 grams of water are carbonated at the reflux temperature (about 95° C.) for one hour. The carbonated mixture is then stripped by first heating to 160° C. with nitrogen blowing (3 cubic feet per hour) and thereafter heating to 165° C. at a pressure of 30 mm. (Hg). This stripped carbonated product is filtered, the filtrate being an oil solution of the desired basic magnesium salt. The salt is characterized by a metal ratio of 2.7.

The following example A-7 illustrates the preparation of phenol salts.

EXAMPLE (A)-7

A phenol sulfide is prepared by reacting sulfur dichloride with a polyisobutenyl phenol in which the polyisobutenyl substituent has an average of 23.8 carbon atoms, in the presence of sodium acetate (an acid acceptor used to avoid discoloration of the product). A mixture of 1755 parts of this phenol sulfide, 500 parts of mineral oil, 335 parts of calcium hydroxide and 407 parts of methanol is heated to about 43–50° C. and carbon dioxide is bubbled through the mixture for about 7.5 hours. The mixture is then heated to drive off volatile matter, an additional 422.5 parts of oil are added to provide a 60% solution in oil. This solution contains 5.6% calcium and 1.59% sulfur.

(B) The Succinimide Dispersant

Succinimide dispersants are the reaction product of a hydrocarbyl substituted succinic acylating agent and an amine. The succinimide dispersants formed depend upon the type of the hydrocarbyl substituted succinic acylating agent employed. Two types of hydrocarbyl substituted succinic acylating agents are envisioned as Type I and Type II. Type I succinic acylating agent is of the formula

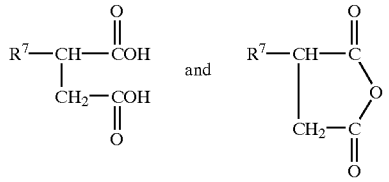

wherein $R^7$ is a hydrocarbyl based substituent having from about 30, often from about 40 up to about 500 carbon atoms and preferably from about 50 to about 300, often to about 200 and frequently to about 100 carbon atoms. Type I hydrocarbyl-substituted succinic acylating agents are prepared by reacting one mole of an olefin polymer or chlorinated analog thereof with one mole of an unsaturated carboxylic acid or derivative thereof such as fumaric acid, maleic acid or maleic anhydride. Typically, the succinic acylating agents are derived from maleic acid, its isomers, anhydride and chloro and bromo derivatives.

$R^7$ is preferably an olefin, preferably alpha-olefin, polymer-derived group formed by polymerization of monomers such as ethylene, propylene, 1-butene, isobutene, 1-pentene, 2-pentene, 1-hexene and 3-hexene. Such groups usually contain from about 30, frequently from about 40, up to about 500, often from about 50 up to about 300, often up to about 200, more often up to about 100 carbon atoms. $R^7$ may also be derived from a high molecular weight substantially saturated petroleum fraction. The hydrocarbon-substituted succinic acids and their derivatives constitute the most preferred class of carboxylic acids.

Included among the useful carboxylic reactants are aliphatic hydrocarbon substituted cyclohexene dicarboxylic acids and anhydrides which may be obtained from the reaction of e.g., maleic anhydride with an olefin while the reaction mass is being treated with chlorine.

Patents describing useful aliphatic succinic acids, anhydrides, and reactive equivalents thereof and methods for preparing them include, among numerous others, U.S. Pat. Nos. 3,163,603 (LeSuer), 3,215,707 (Rense); 3,219,666 (Norman et al), 3,231,587 (Rense); 3,306,908 (LeSuer); 3,912,764 (Palmer); 4,110,349 (Cohen); and 4,234,435 (Meinhardt et al); and U.K. 1,440,219 which are hereby incorporated by reference for their disclosure of useful carboxylic reactants. It should be understood that these patents also disclose derivatives, such as succinimides, etc. which are not reactive equivalents of succinic acids and anhydrides. These are not contemplated as being reactive equivalents of succinic acids or anhydrides.

As indicated in the above-mentioned patents, which are hereby incorporated by reference for their disclosure of compounds useful as reactants for preparing the dispersants used in this invention, the succinic acids (or reactive equivalents thereof) include those derived by the reaction of a maleic or fumaric carboxylic acid or reactive equivalent thereof with a polyalkene or halogenated derivative thereof or a suitable olefin.

The hydrocarbyl group is referred to hereinafter, for convenience, as the "substituent" and is often an aliphatic group derived from a polyalkene. The polyalkene is characterized by $\overline{M}_n$ (number average molecular weight) of at least about 300, preferably at least about 500, more preferably at least about 1000, up to about 7,000. Advantageously, the polyalkene has $\overline{M}_n$ in the range of about 400 to about 7,000, more preferably about 800 to about 3000, more preferably about 800 to about 2000. The polyalkene typically has an $\overline{M}_w/\overline{M}_n$ value of at least about 1.2, often from about 1.5 up to about 5. $\overline{M}_w$ is the conventional symbol representing the weight average molecular weight. The aliphatic hydrocarbyl group may also be derived from higher molecular weight olefins, cracked wax, and other sources readily available in the art.

There is a general preference for aliphatic, hydrocarbon polyalkenes free from aromatic and cycloaliphatic groups. Within this general preference, there is a further preference for polyalkenes which are derived from the group consisting of homopolymers and interpolymers of terminal hydrocarbon olefins of 2 to about 16 carbon atoms, preferably from about 2 to about 6 carbon atoms, more preferably 2 to 4 carbon atoms. Interpolymers optionally containing up to about 40% of polymer units derived from internal olefins of up to about 16 carbon atoms are also within a preferred group. Another preferred class of polyalkenes are the latter more preferred polyalkenes optionally containing up to about 25% of polymer units derived from internal olefins of up to about 6 carbon atoms.

Interpolymers are those in which two or more olefin monomers are interpolymerized according to well-known conventional procedures to form polyalkenes having units within their structure derived from each of said two or more olefin monomers. Thus, "interpolymer(s)", or "copolymers" as used herein is inclusive of polymers derived from two different monomers, terpolymers, tetrapolymers, and the like. As will be apparent to those of ordinary skill in the art, the polyalkenes from which the substituent groups are derived are often conventionally referred to as "polyolefin (s)".

The olefin monomers from which the polyalkenes are derived are polymerizable olefin monomers characterized by the presence of one or more ethylenically unsaturated groups (i.e., >C=C<); that is, they are monolefinic monomers such as ethylene, propylene, 1-butene, isobutene, and 1-octene or polyolefinic monomers (usually diolefinic monomers) such as 1,3-butadiene and isoprene. For purposes of this invention, when a particular polymerized olefin monomer can be classified as both a terminal olefin and an internal olefin, it will be deemed to be a terminal olefin. Thus, 1,3-pentadiene (i.e., piperylene) is deemed to be a terminal olefin for purposes of this invention.

In one preferred embodiment, the substituent is derived from polybutene, that is, polymers of $C_4$ olefins, including 1-butene, 2-butene and isobutylene. Those derived from isobutylene, i.e., polyisobutylenes, are especially preferred. In another preferred embodiment, the substituent is derived from polypropylene. In another preferred embodiment, it is derived from ethylene-alpha olefin polymers, particularly ethylene-propylene polymers and ethylene-alpha olefin-diene, preferably ethylene-propylene-diene polymers. In one embodiment the olefin is an ethylene-propylene-diene copolymer having $\overline{M}_n$ ranging from about 900 to about 2500. An example of such materials are the TRILENE® polymers marketed by the Uniroyal Company, Middlebury, Conn., USA.

Polypropylene and polybutylene, particularly polyisobutylene, are preferred. These typically have number average molecular weight ranging from about 300 to about 7000, often to about 5,000, more often from about 700 to about 2,000.

One preferred source of substituent groups are polybutenes obtained by polymerization of a $C_4$ refinery stream having a butene content of 35 to 75 weight percent and isobutylene content of 15 to 60 weight percent in the presence of a Lewis acid catalyst such as aluminum trichloride or boron trifluoride. These polybutenes contain predominantly (greater than 80% of total repeating units) isobutylene repeating units of the configuration

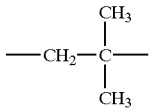

These polybutenes are typically monoolefinic, that is they contain but one olefinic bond per molecule.

The polybutene may be a polyolefin comprising a mixture of isomers wherein from about 50 percent to about 65 percent are tri-substituted olefins wherein one substituent contains from 18 to about 500 aliphatic carbon atoms, often from about 30 to about 200 carbon atoms, more often from about 50 to about 100 carbon atoms, and the other two substituents are lower alkyl.

When the polybutene is a tri-substituted olefin, it frequently comprises a mixture of cis- and trans-1-lower alkyl, 1-(aliphatic hydrocarbyl containing from 30 to about 100 carbon atoms), 2-lower alkyl ethene and 1,1-di-lower alkyl, 2-(aliphatic hydrocarbyl containing from 30 to about 100 carbon atoms) ethene.

In one embodiment, the monoolefinic groups of the polybutenes are predominantly vinylidene groups, i.e., groups of the formula

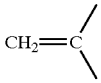

especially those of the formula

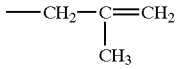

although the polybutenes may also comprise other olefinic configurations.

In one embodiment the polybutene is substantially monoolefinic, comprising at least about 30 mole %, preferably at least about 50 mole % vinylidene groups, more often at least about 70 mole % vinylidene groups. Such materials and methods for preparing them are described in U.S. Pat. Nos. 5,071,919; 5,137,978; 5,137,980; 5,286,823 and 5,408,018, and in published European patent application EP 646103-A1, each of which is expressly incorporated herein by reference. They are commercially available, for example under the tradenames ULTRAVIS® (BP Chemicals) and GLISSOPAL® (BASF).

Specific characterization of polyolefin reactants used in this invention can be accomplished using techniques known to those skilled in the art. These include general qualitative analysis by infrared and determinations of average molecular weight, e.g., $\overline{M}_n$ and $\overline{M}_w$, etc. employing vapor phase osmometry (VPO) and gel permeation chromatography (GPC). Structural details can be elucidated employing proton and carbon 13 ($C^{13}$) nuclear magnetic resonance (NMR) techniques. NMR is useful for determining substitution characteristics about olefinic bonds, and provides some details regarding the nature of the substituents. More specific details regarding substituents about olefinic bonds can be obtained by cleaving the substituents from the olefin by, for example, ozonolysis, then analyzing the cleaved products, also by NMR, GPC, VPO, and by infra-red analysis and other techniques known to the skilled person.

Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC. The techniques for determining $\overline{M}_n$ and $\overline{M}_w$ values of polymers are well known and are described in numerous books and articles. For example, methods for the determination of $\overline{M}_n$ and molecular weight distribution of polymers is described in W. W. Yau, J. J. Kirkland and D. D. Bly, "Modern Size Exclusion Liquid Chromatography", J. Wiley & Sons, Inc., 1979.

The preparation of polyalkenes as described above which meet the various criteria for $\overline{M}_n$ and $\overline{M}_w/\overline{M}_n$ is within the skill of the art and does not comprise part of the present invention. Techniques readily apparent to those skilled in the art include controlling polymerization temperatures, regulating the amount and type of polymerization initiator and/or catalyst, employing chain terminating groups in the polymerization procedure, and the like. Other conventional techniques such as stripping (including vacuum stripping) a very light end and/or oxidatively or mechanically degrading high molecular weight polyalkene to produce lower molecular weight polyalkenes can also be used.

Polyalkenes having the $\overline{M}_n$ and $\overline{M}_w$ values discussed above are known in the art and can be prepared according to conventional procedures. For example, some of these polyalkenes are described and exemplified in U.S. Pat. No. 4,234,435. The disclosure of this patent relative to such polyalkenes is hereby incorporated by reference. Several such polyalkenes, especially polybutenes, are commercially available.

The Type II hydrocarbyl substituted succinic acylating agent is characterized as a polysuccinated hydrocarbyl substituted succinic acylating agent such that more than one mole of an unsaturated carboxylic acid or derivative is reacted with one mole of an olefin polymer or chlorinated analog thereof. U.S. Pat. No. 4,234,435 is expressly incorporated herein by reference for its disclosure of procedures for the preparation of polysuccinated hydrocarbyl-substituted succinic acylating agents and dispersants prepared therefrom.

In another embodiment, the Type II succinic acylating agent consists of substituent groups and succinic groups wherein the substituent groups are derived from polyalkenes characterized by an $\overline{M}_n$ value of at least about 1200 and an $\overline{M}_w/\overline{M}_n$ ratio of at least about 1.5, and wherein said acylating agents are characterized by the presence within their structure of an average of at least about 1.3 succinic groups for each equivalent weight of substituent groups.

This Type II succinic acylating agent can be characterized by the presence within its structure of two groups or moieties. The first group or moiety is referred to hereinafter, for convenience, as the "substituent group(s)" and is derived from a polyalkene. The polyalkene from which the substituted groups are derived is characterized by an $\overline{M}_n$ (number average molecular weight) value of at least 1200 and more generally from about 1500 to about 5000, and an $\overline{M}_w/\overline{M}_n$ value of at least about 1.5 and more generally from about 1.5 to about 6. The second group or moiety is referred to herein as the "succinic group(s)". The succinic groups are those groups characterized by the structure

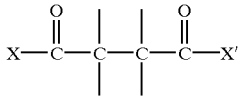

(VIII)

wherein X and X' are the same or different provided at least one of X and X' is such that the second substituted succinic acylating agent can function as carboxylic acylating agents. That is, at least one of X and X' must be such that the substituted acylating agent can form amides or amine salts with, and otherwise function as a conventional carboxylic acid acylating agents. Transesterification and transamidation reactions are considered, for purposed of this invention, as conventional acylating reactions.

Thus, X and/or X' is usually —OH, —O-hydrocarbyl, $—O^-M^+$ where $M^+$ represents one equivalent of a metal, ammonium or amine cation, $—NH_2$, —Cl, —Br, and together, X and X' can be —O— so as to form the anhydride. The specific identity of any X or X' group which is not one of the above is not critical so long as its presence does not prevent the remaining group from entering into acylation reactions. Preferably, however, X and X' are each such that both carboxyl functions of the succinic group (i.e., both —C—(O)X and —(O)X' can enter into acylation reactions.

One of the unsatisfied valences in the grouping

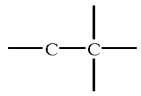

of Formula VIII forms a carbon-to-carbon bond with a carbon atom in the substituent group. While other such unsatisfied valence may be satisfied by a similar bond with the same or different substituent group, all but the said one such valence are usually satisfied by hydrogen; i.e., —H.

The Type II succinic acylating agents are characterized by the presence within their structure of an average of at least about 1.3 succinic groups (that is, groups corresponding to Formula VIII) for each equivalent weight of substituent groups. For purposes of this invention, the number of equivalent weight of substituent groups is deemed to be the number corresponding to the quotient obtained by dividing the $\overline{M}_n$ value of the polyalkene from which the substituent is derived into the total weight of the substituent groups present in the substituted succinic acylating agents. Thus, if the Type II succinic acylating agent is characterized by a total weight of substituent group of 40,000 and the $\overline{M}_n$ value for the polyalkene from which the substituent groups are derived is 2000, then that second substituted succinic acylating agent is characterized by a total of 20 (40,000/2000=20) equivalent weights of substituent groups. Therefore, that particular second succinic acylating agent must also be characterized by the presence within its structure of at least 26 succinic groups to meet one of the requirements of the novel succinic acylating agents of this invention.

Polyalkenes having the $\overline{M}_n$ and $\overline{M}_w$ values discussed above are known in the art and can be prepared according to conventional procedures. Several such polyalkenes, especially polybutenes, are commercially available.

In one preferred embodiment, the succinic groups will normally correspond to the formula

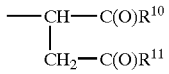

(IX)

wherein $R^{10}$ and $R^{11}$ are each independently selected from the group consisting of —OH, —Cl, —O-lower alkyl, and when taken together, $R^{10}$ and $R^{11}$ are —O—. In the latter case, the succinic group is a succinic anhydride group. All the succinic groups in a particular Type II succinic acylating agent need not be the same, but they can be the same. Preferably, the succinic groups will correspond to

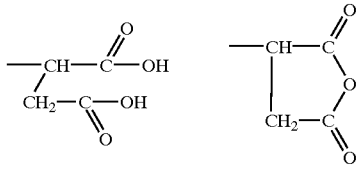

(X)

(A) (B)

and mixtures of (X(A)) and (X(B)). Providing Type II succinic acylating agents wherein the succinic groups are the same or different is within the ordinary skill of the art and can be accomplished through conventional procedures such as treating the substituted succinic acylating agents themselves (for example, hydrolyzing the anhydride to the free acid or converting the free acid to an acid chloride with thionyl chloride) and/or selecting the appropriate maleic or fumaric reactants.

As previously mentioned, the minimum number of succinic groups for each equivalent weight of substituent group is 1.3. The maximum number generally will not exceed 6. Preferably the minimum will be 1.4; usually 1.4 to about 6 succinic groups for each equivalent weight of substituent group. A range based on this minimum is at least 1.5 to about 3.5, and more generally about 1.5 to about 2.5 succinic groups per equivalent weight of substituent groups.

From the foregoing, it is clear that the Type II succinic acylating agents can be represented by the symbol $R^8(R^9)_d$ wherein $R^8$ represents one equivalent weight of substituent group, $R^9$ represents one succinic group corresponding to Formula (VIII), Formula (IX), or Formula (X), as discussed above, and d is a number equal to or greater than 1.3. The more preferred embodiments of the invention could be similarly represented by, for example, letting $R^8$ and $R^9$ represent more preferred substituent groups and succinic groups, respectively, as discussed elsewhere herein and by letting the value of d vary as discussed above.

In addition to preferred substituted succinic groups where the preference depends on the number and identity of succinic groups for each equivalent weight of substituent groups, still further preferences are based on the identity and characterization of the polyalkenes from which the substituent groups are derived.

With respect to the value of $\overline{M}_n$ for example, a minimum of about 1200, often at least about 1300 or about 1500 and a maximum of about 5000 are preferred, more preferably from about 1500 to about 2800, and most preferably from about 1500 to about 2400. With polybutenes, an especially preferred minimum value for $\overline{M}_n$ is about 1700 and an especially preferred range of $\overline{M}_n$ values is from about 1700 to about 2400.

A minimum $\overline{M}_w/\overline{M}_n$ value of about 1.8 is preferred with a range of about 1.8 up to about 5.0 also being preferred. More preferred is about 2.0 to about 4.5, and especially preferred is about 2.5 with a range of from about 2.5 to about 4.0 also being especially preferred.

These preferred characteristics of succinic acylating agents are both independent and dependent. They are independent in the sense that, for example, a preference for a minimum of 1.4 or 1.5 succinic groups per equivalent weight of substituent groups is not tied to a more preferred value of $\overline{M}_n$ or $\overline{M}_w/\overline{M}_n$. They are dependent in the sense that, for example, when a preference for a minimum of 1.4 to 1.5 succinic groups is combined with more preferred values of $\overline{M}_n$ and/or $\overline{M}_w/\overline{M}_n$ the combination of preferences does, in fact, describe still further more preferred embodiments of this component. Thus, the various parameters are intended to stand alone with respect to the particular parameter being discussed but can also be combined with other parameters to identify further preferences. This same concept is intended to apply throughout the specification with respect to the description of preferred values, ranges, ratios, reactants, and the like unless a contrary intent is clearly demonstrated or apparent.

The polyalkenes from which the substituent groups of the Type II acylating agents are derived are homopolymers and interpolymers of polymerizable olefin monomers. These are essentially the same as those described hereinabove with the further limitation of $\overline{M}_w$ and $\overline{M}_w/\overline{M}_n$ particular to Type II succinic acylating agents.

In preparing the Type II succinic acylating agent, one or more of the above-described polyalkenes is reacted with one or more acidic reactants selected from the group consisting of maleic or fumaric reactants of the general formula

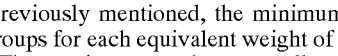

X(O)C—CH=CH—C(O)X' (XI)

wherein X and X' are as defined hereinbefore. Preferably the maleic and fumaric reactants will be one or more compounds corresponding to the formula

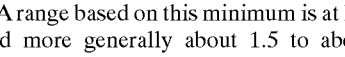

$R^{10}C(O)—CH=CH—C(O)R^{11}$ (XII)

wherein $R^{10}$ and $R^{11}$ are as previously defined herein. Ordinarily, the maleic or fumaric reactants will be maleic acid, fumaric acid, maleic anhydride, or a mixture of two or more of these. Especially preferred reactants are the maleic reactants with maleic anhydride preferred.

The one or more polyalkenes and one or more maleic or fumaric reactants can be reacted according to any of several known procedures in order to produce the Type I or Type II acylating agents of the present invention.

In preparing the succinimide dispersant, the hydrocarbyl substituted succinic acylating agent is reacted with (a) ammonia or (b) an amine having at least one —$NH_2$ group.

Ordinarily substituted succinic anhydride is reacted directly with ammonia or the amine although in some circumstances it may be desirable first to convert the anhydride to the acid.

Amine Reactants

Suitable amine reactants, as defined herein, include monoamines and polyamines. The amine reactants must contain at least one —$NH_2$ group. Thus, only amines having at least one primary amino group are used in preparing the succinimide dispersants of this invention. Polyamines may be used and are preferred, provided that they contain at least one primary amine group. The monoamines generally contain from 1 to about 24 carbon atoms, preferably 1 to about 12, and more preferably 1 to about 6. Examples of monoamines useful in the present invention include primary amines, for example methylamine, ethylamine, propylamine, butylamine, octylamine, and dodecylamine.

In another embodiment, the monoamine may be a hydroxyhydrocarbylamine, usually hydroxyalkylamines. Typically, hydroxyalkylamines are primary alkanolamines. Alkanol amines that can react to form amide can be represented, for example, by the formula:

$$H_2N—R'—OH$$

wherein R' is a divalent hydrocarbyl group of about two to about 18 carbon atoms, preferably two to about four. The group —R'—OH in such formulae represents the hydroxyhydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group.

Examples of these alkanolamines include monoethanolamine, propanolamine, etc.

The hydroxyhydrocarbylamines can also be ether N-(hydroxyhydrocarbyl) amines. These are hydroxy poly (hydrocarbyloxy) analogs of the above-described hydroxy amines (these analogs also include hydroxyl-substituted oxyalkylene analogs). Such N-(hydroxyhydrocarbyl) amines can be conveniently prepared, for example, by reaction of epoxides with aforedescribed amines and can be represented by the formula:

$$H_2N—(R'O)_x—H$$

wherein x is a number from about 2 to about 15 and R' is as described above.

Other useful amines include ether amines of the general formula $$R_6OR^1NH_2$$

wherein $R_6$ is a hydrocarbyl group, preferably an aliphatic group, more preferably an alkyl group, containing from 1 to about 24 carbon atoms and $R^1$ is a divalent hydrocarbyl group, preferably an alkylene group, containing from two to about 18 carbon atoms, more preferably two to about 4 carbon atoms. Especially preferred ether amines are those available under the name SURFAM, produced and marketed by Sea Land Chemical Co., Westlake, Ohio.

The amine is preferably a polyamine. The polyamine may be aliphatic, cycloaliphatic, heterocyclic or aromatic. Examples of the polyamines include alkylene polyamines, hydroxy containing polyamines, arylpolyamines, and heterocyclic polyamines.

Alkylene polyamines are represented by the formula $$HN(R_5)—(Alkylene—N(R_5))_n—R^5$$

wherein n has an average value between about 1 and about 10, preferably about 2 to about 7, more preferably about 2 to about 5, and the "Alkylene" group has from 1 to about 10 carbon atoms, preferably about 2 to about 6, more preferably about 2 to about 4. $R_5$ is independently hydrogen or an aliphatic or hydroxy-substituted aliphatic group of up to about 30 carbon atoms, preferably H or lower alkyl, most preferably H. At least one amino group must be a primary amino group.

Alkylene polyamines include methylene polyamines, ethylene polyamines, butylene polyamines, propylene polyamines, pentylene polyamines, etc. Higher homologs and related heterocyclic amines such as N-amino alkyl-substituted piperazines are also included. Specific examples of such polyamines are ethylene diamine, diethylene triamine, triethylene tetramine, tris-(2-aminoethyl)amine, propylene diamine, trimethylene diamine, tripropylene tetramine, tetraethylene pentamine, hexaethylene heptamine, pentaethylenehexamine, aminoethyl piperazine, dimethyl aminopropylamine, etc.

Higher homologs obtained by condensing two or more of the above-noted alkylene amines are similarly useful as are mixtures of two or more of the aforedescribed polyamines.

Ethylene polyamines, such as some of those mentioned above, are preferred. They are described in detail under the heading "Diamines and Higher Amines" in Kirk Othmer's "Encyclopedia of Chemical Technology", 4th Edition, Vol. 8, pages 74–108, John Wiley and Sons, New York (1993) and in Meinhardf, et al, U.S. Pat. No. 4,234,435, both of which are hereby incorporated herein by reference for disclosure of useful polyamines. Such polyamines are conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as the aforedescribed piperazines. Ethylene polyamine mixtures are useful.

Other useful types of polyamine mixtures are those resulting from stripping of the above-described polyamine mixtures to leave as residue what is often termed "polyamine bottoms". In general, alkylene polyamine bottoms can be characterized as having less than two, usually less than 1% (by weight) material boiling below about 200° C. A typical sample of such ethylene polyamine bottoms obtained from the Dow Chemical Company of Freeport, Tex., designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine), 0.72% triethylenetetramine, 21.74% tetraethylenepentamine and 76.61% pentaethylene hexamine and higher (by weight). These alkylene polyamine bottoms include cyclic condensation products such as piperazine and higher analogs of diethylenetriamine, triethylenetetramine and the like.

Another useful polyamine is a condensation product obtained by reaction of at least one hydroxy compound with at least one polyamine reactant containing at least one primary or secondary amino group. The hydroxy compounds are preferably polyhydric alcohols and amines. Preferably the hydroxy compounds are polyhydric amines. Polyhydric amines include any of the above-described monoamines reacted with an alkylene oxide (e.g., ethylene oxide, propylene oxide, butylene oxide, etc.) having two to about 20 carbon atoms, preferably two to about four. Examples of polyhydric amines include tris-(hydroxymethyl)amino methane and 2-amino-2-methyl-1,3-propanediol.

Polyamine reactants, which react with the polyhydric alcohol or amine to form the condensation products or condensed amines, are described above. Preferred polyamine reactants include triethylenetetramine (TETA), tetraethylenepentamine (TEPA), pentaethylenehexamine (PEHA), and mixtures of polyamines such as the above-described "amine bottoms".

The condensation reaction of the polyamine reactant with the hydroxy compound is conducted at an elevated temperature, usually about 60° C. to about 265° C. in the presence of an acid catalyst.

The amine condensates and methods of making the same are described in Steckel (U.S. Pat. No. 5,053,152) which is incorporated by reference for its disclosure to the condensates and methods of making amine condensates.

In another embodiment, the polyamines are hydroxy-containing polyamines. Hydroxy-containing polyamine analogs of hydroxy monoamines, particularly alkoxylated alkylenepolyamines can also be used. Such polyamines can be made by reacting the above-described alkylene amines with one or more of the above-described alkylene oxides. Similar alkylene oxide-alkanolamine reaction products can also be used such as the products made by reacting the afore-described primary, secondary or tertiary alkanolamines with ethylene, propylene or higher epoxides in a 1.1 to 1.2 molar ratio. Reactant ratios and temperatures for carrying out such reactions are known to those skilled in the art. As noted hereinabove, such hydroxy-containing polyamines must have at least one —$NH_2$ group.

Specific examples of alkoxylated alkylenepolyamines include N-(2-hydroxyethyl) ethylenediamine, N,N-di-(2-hydroxyethyl)-ethylenediamine, mono-(hydroxypropyl)-substituted tetraethylenepentamine, N-(3-hydroxybutyl)-tetramethylene diamine, etc. Higher homologs obtained by condensation of the above illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

In another embodiment, the polyamine may be a heterocyclic polyamine. The heterocyclic polyamines include aminoalkyl substituted heterocycles, including aminoalkyl substituted aziridines, azetidines, azolidines, azepines, azocines, azonines, azecines, tetra- and dihydropyridines, pyrroles, indoles, piperidines, imidazoles, di- and tetrahydroimidazoles, piperazines, isoindoles, purines; N-aminoalkylthiomorpholines, N-aminoalkylmorpholines, N-aminoalkylpiperazines, N,N'-bisaminoalkyl piperazines, and tetra-, di- and perhydro derivatives of each of the above and mixtures of two or more of these heterocyclic amines. Preferred heterocyclic amines are the aminoalkyl substituted saturated 5- and 6-membered heterocyclic amines containing only nitrogen, or nitrogen with oxygen and/or sulfur in the hetero ring, especially the piperidines, piperazines, thiomorpholines, morpholines, pyrrolidines, and the like. Aminoalkylsubstituted piperidines, aminoalkylsubstituted piperazines, aminoalkylsubstituted morpholines, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-amino-ethylpiperazine, and N,N'-diaminoethylpiperazine. Hydroxy alkyl substituted heterocyclic polyamines are also useful.

In another embodiment, the amine is a polyalkene-substituted amine. These polyalkene-substituted amines are well known to those skilled in the art. They are disclosed in U.S. Pat. Nos. 3,275,554; 3,438,757; 3,454,555; 3,565,804; 3,755,433; and 3,822,289. These patents are hereby incorporated by reference for their disclosure of polyalkene-substituted amines and methods of making the same.

Typically, polyalkene-substituted amines are prepared by reacting halogenated-, preferably chlorinated-, olefins and olefin polymers (polyalkenes) with amines (mono- or polyamines). The amines may be any of the amines described above. Examples of these compounds include poly(propylene)amine; polybutene amine; N-poly(butene) ethylenediamine; N-poly(propylene)trimethylenediamine; N-poly(butene)diethylenetriamine; N',N'-poly(butene) tetraethylenepentamine; and the like.

The polyalkene substituted amine is characterized as containing from at least about 8 carbon atoms, preferably at least about 30, more preferably at least about 35 up to about 300 carbon atoms, preferably 200, more preferably 100. In one embodiment, the polyalkene substituted amine is characterized by an n (number average molecular weight) value of at least about 500. Generally, the polyalkene substituted amine is characterized by an n value of about 500 to about 5000, preferably about 800 to about 2500. In another embodiment n varies between about 500 to about 1200 or 1300.

The polyalkenes from which the polyalkene substituted amines are derived include homopolymers and interpolymers, preferably homopolymers, of polymerizable olefin monomers of 2 to about 16 carbon atoms; usually 2 to about 6, preferably 2 to about 4, more preferably 4. The olefins may be monoolefins such as ethylene, propylene, 1-butene, isobutene, and 1-octene; or a polyolefinic monomer, preferably diolefinic monomer, such 1,3-butadiene and isoprene. An example of a preferred homopolymer is a polybutene, preferably a polybutene in which about 50% of the polymer is derived from isobutylene. The polyalkenes are prepared by conventional procedures.

The number of equivalents of acylating agent depends on the total number of carboxylic functions present. In the determination of the number of equivalents of acylating agent, carboxyl functions which are not capable of reacting as a carboxylic acid acylating agent are excluded. In general, there is one equivalent of acylating agent for each carboxy group in the acylating agents. Conventional methods for determining the number of carboxyl functions (e.g., acid number, saponification number, etc.) are available and are well known to those skilled in the art.

An equivalent weight of monoamine is the molecular weight of the amine. The equivalent weight of mixtures of monoamines can be determined by dividing the atomic weight of nitrogen (14) by the %N contained in the mixture and multiplying by 100. Equivalent weight of polyamines can be determined similarly.

Amounts of polyamines are often referred to in equivalents. One equivalent of a polyamino compound or derivative thereof is its formula weight divided by the average number of nitrogen atoms therein which contain a basic —$NH_2$ group. Thus ethylene diamine contains 2 equivalents; N,N-dimethyl-propanediamine contains one equivalent.

In another embodiment, the polyamine may be a hydroxyamine provided that the polyamine contains at least one condensable —$NH_2$ group. Typically, the hydroxyamines are primary alkanol amines. Such amines can be represented by mono- and poly-N-hydroxyalkyl substituted allylene polyamines wherein the alkylene polyamines are as described hereinabove; especially those that contain two to three carbon atoms in the alkylene radicals and the alkylene polyamine contains up to seven amino groups.

The succinimide dispersants are frequently basic, that is they display a base number. The base number is usually expressed as total base number as described hereinabove.

The base number of the succinimide dispersant arises from the presence of the amine reactant, usually the amount of unreacted amino moiety present in the dispersant. These base numbers can vary over a wide range, but values ranging from about 5 to about 200, on a diluent-free basis, often from about 15 to about 100, frequently from about 30 to about 60. In one preferred embodiment, the dispersant has TBN of at least about 40.

Specific examples of the process by which the succinic dispersants may be prepared follow:

EXAMPLE (B)-1

A polyisobutenyl succinic anhydride is prepared by the reaction of a chlorinated polyisobutylene with maleic anhydride at 200° C. The polyisobutenyl radical has average molecular weight of 850 and the resulting alkenyl succinic anhydride is found to have an acid number of 113 (corresponding to an equivalent weight of 500). To a mixture of 500 grams (1 equivalent) of this polyisobutenyl succinic anhydride and 160 grams of toluene are added at room temperature 35 grams (1 equivalent) of diethylene triamine. The addition is made portionwise over 0.25 hour with an initial exothermic reaction causing the temperature to rise to 50° C. The mixture is heated and a water-toluene azeotrope distilled from the mixture. When water formation essentially ceases, the mixture is heated to 150° C. at reduced pressure to remove the toluene. The residue is diluted with 350 grams of mineral oil. The solution has %N=1.6.

EXAMPLE (B)-2

The procedures of Example (B)-1 is repeated using 31 grams (1 equivalent) of ethylene diamine as the amine reactant. The product has %N=1.4.

EXAMPLE (B)-3

The procedure of Example (B)-1 s repeated using 55.5 grams (1.5 equivalents) of an ethylene amine mixture having a composition corresponding to that of triethylene tetramine. The resulting product has %N=1.9.

EXAMPLE (B)4

The procedure of Example (B)-1 is repeated using 55.0 grams (1.5 equivalents) of triethylene tetramine as the amine reactant. The resulting product has %N=2.2.

EXAMPLE (B)-5

To a mixture of 140 grams of toluene and 400 grams (0.78 equivalent) of a polyisobutenyl succinic anhydride (having an acid number of 109 and prepared from maleic anhydride and the chlorinated polyisobutylene of Example (B)-1) there is added at room temperature 63.6 grams (1.55 equivalents) of an ethylene amine mixture having an average composition corresponding to that of tetraethylene pentamine (Polyamine H, Union Carbide). The mixture is heated to distill water-toluene azeotrope and then to 150° C. at reduced pressure to remove the remaining toluene. The residual polyamide has %N=4.7%.

EXAMPLE (B)-6

The procedure of Example (B)-1 was repeated using 46 grams (1.5 equivalents) of ethylene diamine as the amine reactant. The product has %N=1.5.

EXAMPLE (B)-7

A polyisobutenyl succinic anhydride having an acid number of 105 and an equivalent weight of 540 is prepared by the reaction of a chlorinated polyisobutylene (having an average molecular weight of 1,050 and a chlorine content of 4.3%) and maleic anhydride. To a mixture of 300 parts by weight of the polyisobutenyl succinic anhydride and 160 parts of weight of mineral oil there are added at 65–95° C. an equivalent amount (25 parts of weight) of Polyamine H. This mixture is heated to 150° C. to remove water formed in the reaction then is $N_2$ blown at this temperature to remove remaining water. The residue is diluted with 79 parts mineral oil. The oil has %N=1.6%.

EXAMPLE (B)-8

A mixture of 2,112 grams (3.9 equivalent) of the polyisobutenyl succinic anhydride of Example (B)-7, 136 grams (3.9 equivalents) of diethylene triamine, and 1,060 grams of mineral oil s heated at 140–150° C. for one hour. Nitrogen is bubbled through the mixture at this temperature for four more hours to aid in the removal of water. The residue is diluted with 420 grams of mineral oil. The oil solution has %N=1.3.

EXAMPLE (B)-9

To a solution of 1,000 grams (1.87 equivalents) of the polyisobutenyl succinic anhydride of Example (B)-7, in 500 grams of mineral oil is added, at 85–95° C. 70 grams (1.87 equivalents) of tetraethylene pentamine. The mixture is heated at 150–165° C. for four hours, blowing with nitrogen to aid in the removal of water. The residue is diluted with 200 grams of mineral oil. The oil solution has %N=1.4.

EXAMPLE (B)-10

A mixture of 510 parts (0.28 mole) of polyisobutene ($\overline{M}_n$=1845; $\overline{M}_w$=5325) and 59 parts (0.59 mole) of maleic anhydride is heated to 110° C. This mixture is heated to 190° C. for seven hours during which 43 parts (0.6 mole) of gaseous chlorine are added beneath the surface. At 190°–192° C. an additional 11 parts (0.16 mole) of chlorine are added over 3.5 hours. The reaction mixture is stripped by heating at 190°–193° C. with nitrogen blowing for 10 hours. The residue is a polyisobutene-substituted Type II succinic acylating agent having a saponification number of 87 (ASTM D-94).

A mixture is prepared by the addition, at 138° C., of 10.2 parts (0.25 equivalent) of a commercial mixture of ethylene polyamines having about 3 to about 10 nitrogen atoms per molecule to 113 parts of mineral oil and 161 parts (0.25 equivalent) of the substituted succinic acylating agent prepared above. The reaction mixture is heated to 150° C. in 2 hours and stripped by blowing with nitrogen. The reaction mixture is filtered.

EXAMPLE (B)-11

A mixture of 1000 parts (0.495 mole) of polyisobutene ($\overline{M}_n$=2020; $\overline{M}_w$=6049) and 115 parts (1.17 moles) of maleic anhydride is heated to 110° C. This mixture is heated to 184° C. in 6 hours during which 85 parts (1.2 moles) of gaseous chlorine is added beneath the surface. At 184°–189° C. an additional 59 parts (0.83 mole) of chlorine is added over 4 hours. The reaction mixture is stripped by heating at 186°–190° C. with nitrogen blowing for 26 hours. The residue is a polyisobutene-substituted Type II succinic acylating agent having a saponification equivalent number of 87.

A mixture is prepared by the addition, at 140°–145° C., of 57 parts (1.38 equivalents) of a commercial mixture of ethylene polyamines having from about 3 to 10 nitrogen atoms per molecule to 1067 parts of mineral oil and 893 parts (1.38 equivalents) of the above-prepared succinic acylating agent. The reaction mixture is heated to 155° C. in 3 hours and stripped by blowing with nitrogen. The reaction mixture is filtered.

EXAMPLE (B)-12

A reactor is charged with 1000 parts (0.5 mole) of polyisobutene ($\overline{M}_n$=2000, $\overline{M}_w$=7000). At 135° C. 106 parts (1.08 moles) of maleic anhydride are added, the temperature is increased to 165° C. and gaseous chlorine, 90 parts (1.27 moles) is added over a six hour period. During the chlorine addition, the temperature increases to 190° C. This is a Type II succinic anhydride having acid number=95.

To 1000 parts of the above product are added 1050 parts diluent oil. The materials are heated to 110° C. at which time 69.4 parts (1.83 equivalents) of polyamines are added while the temperature increases to 132° C. The temperature is increased to 150° C. while blowing with $N_2$. Oil, 145 parts, is added and the contents are filtered. The filtrate contains 53% oil, %N=1.1 and has TBN=21.

EXAMPLE (B)-13

A solution is prepared from 1000 parts of the succinic anhydride of Example (B)-12 and 1181 parts mineral oil. The solution is heated to 110° C. and 59.7 parts of an ethylene amine mixture (25% diethylene triamine and the balance polyethylene amine bottoms, Union Carbide) are added over 2 hours while the temperature is allowed to rise exothermically to 127° C. The temperature is increased to 152° C. and is maintained for 1 hour with $N_2$ blowing then the materials are filtered. The filtrate is adjusted with additional mineral oil to 55% oil, base no=15 and %N=0.9.

EXAMPLE (B)-14

A reactor is charged with 1000 parts of polybutene having a number average molecular weight determined by vapor phase osmometry of about 950 and which consists primarily of isobutene units, followed by the addition of 108 parts of maleic anhydride. The mixture is heated to 110° C. followed by the sub-surface addition of 100 parts $Cl_2$ over 6.5 hours at a temperature ranging from 110 to 188° C. The exothermic reaction is controlled as not to exceed 188° C. The batch is blown with nitrogen then stored.

A succinimide dispersant is prepared by reacting 1000 parts of the substituted succinic anhydride of this example with 85 parts of a commercial ethylene polyamine mixture having an average nitrogen content of about 34.5% in 820 parts mineral oil diluent under conditions described in LeSuer, U.S. Pat. No. 3,172,892. The product contains 1.5% N and has TBN=30.

For environmental reasons, it has now become desirable to eliminate or reduce the level of chlorine in lubricating oil compositions. One method of eliminating chlorine contained in lubricant and fuel additives is avoid chlorine in the manufacturing process. Another approach is to treat compositions to remove chlorine. One procedure for treating chlorine-containing compositions to reduce the level of chlorine therein is described in European patent publication EP 665,242. The procedure described therein comprises introducing a source of iodine or bromine into the composition, contacting the components of the resulting mixture for a sufficient amount of time to reduce the chlorine content without substantially incorporating iodine or bromine. This procedure successfully reduces chlorine content, but, in some instances, it is desirable to further reduce the amount of chlorine in compositions which are to be utilized in lubricants and fuels.

One method for reducing the amount of chlorine in additive compositions based on polyalkenyl-substituted dicarboxylic acids is to prepare such hydrocarbon-substituted dicarboxylic acids in the absence of chlorine, and procedures have been described for preparing such compounds by the "ene" process in which the polyolefin and the unsaturated dicarboxylic acid are heated together, optionally in the presence of a catalyst. Using this procedure, it is often more difficult to incorporate an excess of the succinic groups into the polyalkenyl-substituted succinic acylating agents.

In yet another method, the amount of chlorine employed during reaction to prepare the polyalkenyl substituted acylating agent is reduced. In particular, this method is employed when the polyolefin reactant has $\overline{M}_n$ ranging from about 300 to about 10,000, more often from about 500 to about 2,500, and has a high level of tri- and tetra-substituted unsaturated end groups, especially in amounts up to about 90 mole %. Chlorine is used on a molar basis up to an amount equal to the number of moles of tetra- and tri-substituted end groups. Preferably, the halogen to polyolefin molar ratio is about 0.9:1 or less.

The reaction is conducted under conditions of time and temperature, typically wherein said temperature ranges between about 20° C.–175° C., to effect the reaction of the end groups and the chlorine to produce a polyolefin having labile chlorine substituents.

In one embodiment, the chlorination is conducted in the presence of a substantially chlorine inert liquid, for example hexane, as a solvent, and wherein said mixture is heated at a temperature of less than about 70° C. In another embodiment, the reaction is carried out using a dilution gas. Preferred dilution gases are $N_2O$, $CO_2$ or $N_2$.

The polyalkenyl substituted acylating agent is prepared by reacting the labile chlorine containing polyolefin with an α-β-unsaturated compound, said compound comprising α-β-unsaturated acids, anhydrides, derivatives or mixtures thereof and reacting the mixture under time and temperature parameters selected to effect reaction of the polyolefin with the α-β-unsaturated compound to produce a polyolefin substituted reaction product having low chlorine content. Typically, the chlorine content of said substituted reaction product is 1000 parts per million or less on an oil-free basis.

Preferably, the polyolefin substituted reaction product is a polybutene substituted succinic acid, anhydride or mixture thereof or derivative thereof.

The following examples illustrate several methods for reducing chlorine content.

EXAMPLE (B)-15

A polyisobutenyl (molecular weight of 1000) succinic anhydride is prepared according to Example (B)-7. After obtaining the anhydride, 1000 parts of it is treated with 4 parts of iodine which lowers the chlorine content to 0.1 percent. This anhydride is diluted with 667 parts of diluent oil and 1000 parts of the oil diluted anhydride is reacted with 103 parts of a commercial mixture of polyamines. A succinimide dispersant is obtained having a 40% oil content, 45 total base number and 2.0% nitrogen.

EXAMPLE (B)-16

Following essentially the same procedure of Example (B)-12, 1000 grams of the polyisobutene is reacted with a total of 106 grams maleic anhydride and a total of 90 grams chlorine. After obtaining the anhydride, 1000 parts of it is treated with 4 parts of iodine which lowers the chlorine content to 0.1 percent. To 1000 grams of this anhydride are added 207 grams of diluent oil. The contents are heated to 110° C. and 39 grams of a commercial mixture of polyamines are added over a two-hour period while allowing the contents to exotherm to 127° C. The contents are heated to 152° C. and held for one hour with nitrogen blowing to remove water of reaction. Additional oil is added, 23 grams, and the contents are filtered to give a product containing 50% oil, 1.05% nitrogen, 250 ppm halogen and 18 total base number.

(C) The Metal Dihydrocarbyl Dithiophosphate

The metal dihydrocarbyl dithiophosphate is characterized by the formula (XIII)

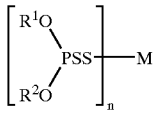

wherein $R^1$ and $R^2$ are each independently hydrocarbyl groups containing from 3 to about 13 carbon atoms, M is a metal, and n is an integer equal to the valence of M.

The hydrocarbyl groups $R^1$ and $R^2$ in the dithiophosphate may be alkyl, cycloalkyl, aralkyl or alkaryl groups, or a substantially hydrocarbon group of similar structure. By "substantially hydrocarbon" is meant hydrocarbons which contain substituent groups such as ether, ester, nitro, or halogen which do not materially affect the hydrocarbon character of the group.

Illustrative alkyl groups include isopropyl, isobutyl, n-butyl, sec-butyl, the various amyl groups, n-hexyl, methylisobutyl carbinyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals. Many substituted hydrocarbon groups may also be used, e.g., chlorophentyl, dichlorophenyl, and dichlorodecyl.

In another embodiment, at least one of $R^1$ and $R^2$ in Formula XIII is an isopropyl or secondary butyl group. In yet another embodiment, both $R^1$ and $R^2$ are secondary alkyl groups.

The phosphorodithioic acids from which the metal salts useful in this invention are prepared are well known. Examples of dihydrocarbyl phosphorodithioic acids and metal salts, and processes for preparing such acids and salts are found in, for example, U.S. Pat. Nos. 4,263,150; 4,289,635; 4,308,154; and 4,417,990. These patents are hereby incorporated by reference for such disclosures.

The phosphorodithioic acids are prepared by the reaction of phosphorus pentasulfide with an alcohol or phenol or mixtures of alcohols. The reaction involves four moles of the alcohol or phenol per mole of phosphorus pentasulfide, and may be carried out within the temperature range from about 50C. to about 200° C. Thus, the preparation of O,O-di-n-hexyl phosphorodithioic acid involves the reaction of phosphorus pentasulfide with four moles of n-hexyl alcohol at about 100° C. for about two hours. Hydrogen sulfide is liberated and the residue is the defined acid. The preparation of the metal salt of this acid may be effected by reaction with metal oxide. Simply mixing and heating these two, reactants is sufficient to cause the reaction to take place and the resulting product is sufficiently pure for the purposes of this invention.

The metal salts of dihydrocarbyl dithiophosphates which are useful in this invention include those salts containing Group I metals, Group II metals, aluminum, lead, tin, molybdenum, manganese, cobalt, nickel or mixtures thereof. The Group II metals, aluminum, tin, iron, cobalt, lead, molybdenum, manganese, nickel and copper are among the preferred metals. Zinc and copper either alone or in combination are especially useful metals. In one embodiment, the lubricant compositions of the invention contain examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontium hydroxide, cadmium oxide, cadmium hydroxide, barium oxide, aluminum oxide, iron carbonate, copper hydroxide, lead hydroxide, tin butyrate, cobalt hydroxide, nickel hydroxide, nickel carbonate, etc.

In some instances, the incorporation of certain ingredients such as small amounts of the metal acetate or acetic acid in conjunction with the metal reactant will facilitate the reaction and result in an improved product. For example, the use of up to about 5% of zinc acetate in combination with the required amount of zinc oxide facilitates the formation of a zinc phosphorodithioate.

In one preferred embodiment, the alkyl groups $R^1$ and $R^2$ are derived from secondary alcohols such as isopropyl alcohol, secondary butyl alcohol, 2-pentanol, 4-methyl-2-pentanol, 2-hexanol, 3-hexanol, etc.

Especially useful metal phosphorodithioates can be prepared from phosphorodithioic acids which in turn are prepared by the reaction of phosphorus pentasulfide with mixtures of alcohols. In addition, the use of such mixtures enables the utilization of cheaper alcohols which in themselves may not yield oil-soluble phosphorodithioic acids.

Useful mixtures of metal salts of dihydrocarbyl dithiophosphoric acid are obtained by reacting phosphorus pentasulfide with a mixture of (a) isopropyl or secondary butyl alcohol, and (b) an alcohol containing at least 5 carbon atoms wherein at least 10 mole percent, preferably 20 or 25 mole percent, of the alcohol in the mixture isopropyl alcohol, secondary butyl alcohol or a mixture thereof.

Thus, a mixture of isopropyl and hexyl alcohols can be used to produce a very effective, oil-soluble metal phosphorodithioate. For the same reason, mixtures of phosphorodithioic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-1-hexanol; isobutanol and n-hexanol; isobutanol and isoamyl alcohol; isopropanol and 4-methyl-2-pentanol; isopropanol and sec-butyl alcohol; isopropanol and isooctyl alcohol; etc. Particularly useful alcohol mixtures are mixtures of secondary alcohols containing at least about 20 mole percent of isopropyl alcohol, and in a preferred embodiment, at least 40 mole percent of isopropyl alcohol.

The following examples illustrate the preparation of metal phosphorodithioates prepared from mixtures of alcohols.

EXAMPLE (C)-1

A phosphorodithioic acid is prepared by reacting a mixture of alcohols comprising 6 moles of 4-methyl-2-pentanol and 4 moles of isopropyl alcohol with phosphorus pentasulfide. The phosphorodithioic acid then is reacted with an oil slurry of zinc oxide. The amount of zinc oxide in the slurry is about 1.08 times and theoretical amount required to completely neutralize the phosphorodithioic acid. The oil solution of the zinc phosphorodithioate obtained in this manner (10% oil) contains 9.5% phosphorous, 20.0% sulfur and 10.5% zinc.

EXAMPLE (C)-2

A phosphorodithioic acid is prepared by reacting finely powdered phosphorus pentasulfide with an alcohol mixture containing 11.53 moles (692 parts by weight) of isopropyl alcohol and 7.69 moles (1000 parts by weight) of isooctanol. The phosphorodithioic acid obtained in this manner has an acid number of about 178–186 and contains 10.0% phosphorus and 21.0% sulfur. This phosphorodithioic acid is then reacted with an oil slurry of zinc oxide. The quantity of zinc oxide included in the oil slurry is 1.10 times the theoretical equivalent of the acid number of the phosphorodithioic acid. The oil solution of the zinc salt prepared in this manner contains 12% oil, 8.6% phosphorus, 18.5% sulfur and 9.5% zinc.

EXAMPLE (C)-3

A phosphorodithioic acid is prepared by reacting a mixture of 1560 parts (12 moles) of isooctyl alcohol and 180 parts (3 moles) of isopropyl alcohol with 756 parts (3.4 moles) of phosphorus pentasulfide. The reaction is conducted by heating the alcohol mixture to about 55° C. and thereafter adding the phosphorus pentasulfide over a period of 1.5 hours while maintaining the reaction temperature at about 60°–75° C. After all of the phosphorus pentasulfide is added, the mixture is heated and stirred for an additional hour at 70°–75° C., and thereafter filtered through a filter aid.

Zinc oxide (282 parts, 6.87 moles) is charged to a reactor with 278 parts of mineral oil. The above-prepared phosphorodithioic acid (2305 parts, 6.28 moles) is charged to the zinc oxide slurry over a period of 30 minutes with an exotherm to 60° C. The mixture then is heated to 80° C. and maintained at this temperature for 3 hours. After stripping to 100° C. and 6 mm. Hg., the mixture is filtered twice through a filter aid, and the filtrate is the desired oil solution of the zinc salt containing 10% oil, 7.97% zinc (theory 7.40); 7.21% phosphorus (theory 7.06); and 15.64% sulfur (theory 14.57).

EXAMPLE (C)4

Isopropyl alcohol (396 parts, 6.6 moles) and 1287 parts (9.9 moles) of isooctyl alcohol are charged to a reactor and heated with stirring to 59C. Phosphorus pentasulfide (833 parts, 3.75 moles) is then added under a nitrogen sweep. The addition of the phosphorus pentasulfide is completed in about 2 hours at a reaction temperature between 59°–63° C. The mixture then is stirred at 45°–63° C. for about 1.45 hours and filtered. The filtrate is the desired phosphorodithioic acid.

A reactor is charged with 312 parts (7.7 equivalents) of zinc oxide and 580 parts of mineral oil. While stirring at room temperature, the above-above-prepared phosphorodithioic acid (2287 parts, 6.97 equivalents) is added over a period of about 1.26 hours with an exotherm to 54° C. The mixture is heated to 78° C. and maintained at 75°–85° C. for 3 hours. The reaction mixture is vacuum stripped to 100° C. at 19 mm. Hg. The residue is filtered through a filter aid, and the filtrate is an oil solution (19.2% oil) of the desired zinc salt containing 7.86% zinc, 7.76% phosphorus and 14.8% sulfur.

EXAMPLE (C)-5

The general procedure of Example (C)-4 is repeated except that the mole ratio of isopropyl alcohol to isooctyl alcohol is 1:1. The product obtained in this manner is an oil solution (10% oil) of the zinc phosphorodithioate containing 8.96% zinc, 8.49% phosphorus and 18.05% sulfur.

EXAMPLE (C)-6

A phosphorodithioic acid is prepared in accordance with the general procedure of Example (C)-4 utilizing an alcohol mixture containing 520 parts (4 moles) of isooctyl alcohol and 360 parts (6 moles) of isopropyl alcohol with 504 parts (2.27 moles) of phosphorus pentasulfide. The zinc salt is prepared by reacting an oil slurry of 116.3 parts of mineral oil and 141.5 parts (3.44 moles of zinc oxide with 950.8 parts (3.20 moles) of the above-prepared phosphorodithioic acid. The product prepared in this manner is an oil solution (10% mineral oil) of the desired zinc salt, and the oil solution counting 9.36% zinc, 8.81% phosphorus and 18.65% sulfur.

EXAMPLE (C)-7

A mixture of 520 parts (4 moles) of isooctyl alcohol and 559.8 parts (9.33 moles) of isopropyl alcohol is prepared and heated to 60° C. at which time 672.5 parts (3.03 moles) of phosphorus pentasulfide are added in portions while 15 stirring. The reaction then is maintained at 60°–65° C. for about one hour and filtered. The filtrate is the desired phosphorodithioic acid.

An oil slurry of 188.6 parts (4 moles) of zinc oxide and 144.2 parts of mineral oil is prepared, and 1145 parts of the above-prepared phosphorodithioic acid are added in portions while maintaining the mixture at about 70° C. After all of the acid is charged, the mixture is heated at 80° C. for 3 hours. The reaction mixture then is stripped of water to 110° C. The residue is filtered through a filter aid, and the filtrate is an oil solution (10% mineral oil) of the desired product containing 9.99% zinc, 19.55% sulfur and 9.33% phosphorus.

EXAMPLE (C)-8

A phosphorodithioic acid is prepared by the general procedure of Example (C)-4 utilizing 260 parts (2 moles) of isooctyl alcohol, 480 parts (8 moles) of isopropyl alcohol, and 504 parts (2.27 moles) of phosphorus pentasulfide. The phosphoiodithioic acid (1094 parts, 3.84 moles) is added to an oil slurry containing 181 parts (4.41 moles) of zinc oxide and 135 parts of mineral oil over a period of 30 minutes. The mixture is heated to 80C. and maintained at this temperature for 3 hours. After stripping to 100C. and 19 mm. Hg., the mixture is filtered twice through a filter aid, and the filtrate is an oil solution (10% mineral oil) of the zinc salt containing 10.06% zinc, 9.04% phosphorus, and 19.2% sulfur.

EXAMPLE (C)-9

Isopropyl alcohol (410 parts, 6.8 moles) and 590 parts (4.5 moles) 2-ethylhexyl alcohol are charged to a reactor and heated to 50° C. Phosphorus pentasulfide (541 parts, 2.4 moles) is added under a nitrogen sweep. The addition is complete in 1.5 hours at a reaction temperature of from 50–65° C. The contents are stirred for 2 hours and filtered at 55° C. to give the desired phosphorodithioic acid.

A reactor is charged with 145 parts (3.57 equivalents) of zinc oxide and 116 parts oil. Stirring is begun and added is 1000 parts (3.24 equivalents) of the above obtained phosphorodithioic acid over a 1 hour period beginning at room temperature. The addition causes an exotherm to 52° C. The contents are heated to 80° C. and maintained at this temperature for 2 hours. The contents are then vacuum stripped to 100° C. at 22 millimeters mercury. Added is 60 parts oil and the contents are filtered to give the desired product containing 12% oil, 9.5% zinc, 18.5% sulfur and 8.6% phosphorus.

EXAMPLE (C)-10

Following the procedure of Example (C)-9, a phosphorodithioic acid is prepared by reacting 1000 parts of an alcohol mixture comprising 46.8% weight isopropyl alcohol and 53.2% weight 4methyl-2-pentanol, and 642 parts (2.89 moles) phosphorus pentasulfide. To 1000 parts of this acid is added 56 parts diluent oil and 157.5 parts (1.9 moles) zinc oxide. Additional oil is added (28.6 parts) and the contents are filtered to give a product containing 9% oil, 10.0% phosphorus, 11.05% zinc and 21% sulfur.

Other Additives

Additive-concentrates and lubricating oil compositions of this invention may contain other additives. The use of such additives is optional and the presence thereof in the compositions of this invention will depend on the particular use and level of performance required. Thus the other additive may be included or excluded.

One or more zinc salts of dithiophosphoric acids other than those described herein as component (C) may be present in a minor amount to provide additional extreme pressure, anti-wear and anti-oxidancy performance.

Other additives that may optionally be used in the lubricating oils of this invention include, for example, auxiliary dispersants, viscosity improvers, oxidation inhibitors, corrosion inhibitors, pour point depressants, extreme pressure agents, anti-wear agents, color stabilizers, friction modifiers, and anti-foam agents.

The above-illustrated other additives are well known in the art and are described in numerous patents and publications. They may each be present in lubricating compositions at a concentration of as little as 0.001% by weight, usually ranging from about 0.01% to about 20% by weight. In most instances, when used, each contributes from about 0.1% to about 10% by weight, more often up to about 5% by weight.

Additive Concentrates

Lubricating oil compositions of this invention may be prepared by directly adding each ingredient to the oil of lubricating viscosity. Preferably, however, they are usually supplied as an additive concentrate wherein the additives, usually a mixture of two or more thereof, are diluted with a substantially inert, normally liquid least about 20% by weight of additives, often as much as 80% by weight. Additive concentrates are prepared by mixing together the desired components, often at elevated temperatures, usually less than 150° C., often no more than about 130° C., frequently no more than about 100° C.

The following example illustrates a lubricating oil composition used in the method of this invention:

EXAMPLE I

An engine lubricating oil composition is prepared by combining 10 parts of an additive concentrate containing 57.5% of the dispersant of Example (B)-13, 9.2 parts of the zinc dithiophosphate of Example (C)-10, 2.52 parts of di(nonylphenyl) amine, 7 parts sulfurized $C_{12-18}$ olefin, 5 parts 2,6-di tertiary butyl-4-(propylene tetramer) phenol, 4.6 parts of the product of Example (A)-2, 6.8 parts of the product of Example (A)-1, 0.09 parts of a kerosene solution of a silicone antifoam agent, and sufficient mineral oil to make 100 parts additive concentrate, with 0.13 parts of a polymethacrylate pour point depressant, 0.74% of an ethylene-propylene polymer viscosity improver and a mineral oil basestock (Chevron RLOP 100N) to make a total of 100 parts of lubricating oil composition.

Comparative Example I

An engine lubricating oil composition, identical in every respect to that of Example I is prepared except 6.8 parts of the product of Example (A)-1 in the additive concentrate is replaced (equal TBN basis) with 5.2 parts of a 68% in oil solution of magnesium overbased alkyl benzene sulfonate.

Comparative Example II

An engine lubricating oil composition, identical in every respect to that of Example I is prepared except the 4.6 parts of the product of Example (A)-2 is replaced (equal TBN basis) with an additional 6.9 parts (total 13.7 parts) of the product of Example (A)-1.

Fuel consumption and tailpipe emissions of engines lubricated with lubricants of Example I and comparative Example I were measured using the procedure described in Part 86 of Title 40 of the Code of Federal Regulations, entitled 'Protection of the Environment', pubulished by the U.S. Government Printing Office (1996). Briefly, the procedure involves operating a test vehicle using the Federal Test Procedure (FTP) cycle, an emission certification test procedure used for light duty vehicles employing a Clayton Model ECE-50 chassis dynamometer.

Exhaust sampling was conducted using a constant volume sampler. The emissions are analyzed and reported.

Fuel consumption is measured using volumetric and gravimetric procedures. During testing, fuel is supplied to the engine from a container.

It was found that both fuel consumption and $NO_x$ emissions were reduced employing the lubricant of Example I, a lubricant of the instant invention.

The data in the following table illustrate the surprising effect of the lubricant of the instant invention compared to a comparative lubricant. $NO_x$ emissions are reported in grams per mile.

| | Lubricant I | Comparative Lubricant I |
|---|---|---|
| % Reduced in Fuel Consumption over Baseline | 2.41 | 1.48 |
| $NO_x$ Emissions: | | |
| 3-Bag Composite * | 0.22 | 0.26 |
| Cold Transient (Bag 1) ‡ | 0.48 | 0.52 |
| Stabilized (Bag 2) | 0.19 | 0.19 |
| Hot Transient (Bag 3) † | 0.14 | 0.20 |

* Statistically significant @ 98% confidence interval
‡ Statistically significant @ 80% confidence interval
† Statistically significant @ 99% confidence interval It has also surprisingly been discovered that combustion chamber deposits formed during operation with the all calcium detergent system of Comparative Example II are removed using the calcium and sodium detergent system of Example I following operation with the lubricant of Comparative Example 2. After 12,500 miles using the lubricant of Comparative Example 2, heavy piston crown deposits are observed. The lubricant is changed to that of Example I.

After only 500 miles of operation with the lubricant of Example I, a noticeable reduction in the amount of piston crown deposits is observed. After a total of 12,500 miles using the lubricant of Example 1, piston crown deposits are further reduced.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

Each of the documents referred to above is incorporated herein by reference. Except in the examples, or where otherwise explicitly indicated, all numerical quantities in this description specifying amounts of materials, reaction conditions, molecular weights, number of carbon atoms, and the like, are to be understood as modified by the word "about". Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined.

While the invention has been explained in relation to its preferred embodiments, it is to be understood that various modifications thereof will become apparent to those skilled in the art upon reading the disclosure. Therefore, it is to be understood that the invention disclosed herein is intended to cover such modifications as fall within the scope of the appended claims.

What is claimed is:

1. A lubricating oil composition comprising a major amount of an oil of lubricating viscosity and an additive system comprising (A) from about 0.1 about 5% by weight of a detergent composition comprising at least two metal overbased compositions wherein said detergent composition consists essentially of (A-1) at least one alkali metal overbased sulfonate detergent having a metal ratio of at least about 10:1, and (A-2) at least one calcium overbased sulfonate detergent having a metal ratio of at least about 10:1, wherein the ratio of total base number on a per 100 TBN and diluent-free basis contributed by the alkali metal salfonate detergent to the total base number contributed by the calcium sulfonate detergent ranges from about (99.5–20) to about (0.5–80):

(B) from about 1 to about 10% by weight of a succinimide dispersant; and (C) from about 0.1 to about 5% by weight of a metal dihydrocarbyl dithiophosphate of the formula

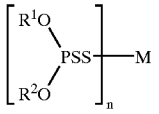

wherein $R^1$ and $R^2$ are each, independently, hydrocarbyl groups containing from 3 to 13 carbon atoms. M is a metal and n is an integer equal to the valence of M.

2. The composition of claim 1 wherein the alkali metal comprises sodium.

3. The composition of claim 1 wherein the hydrocarbyl substituted succinic acylating agent is reacted with an amine comprising a monoamine or a polyamine wherein the dispersant has a total base number of at least 40 on an oil-free basis.

4. The composition of claim 1 wherein the dispersant is derived from a chlorine containing polyolefin wherein the polyolefin has $\overline{M}_n$ ranging from about 300 to about 10,000 and has a total of tetra-and tri-substituted unsaturated end groups in an amount of up to about 90 mole percent based on the moles of said polyolefin reacted with chlorine wherein said chlorine is used on a molar basis up to about an amount equal to the moles of tetra-and tri-substituted end groups and reacting the mixture under time and temperature parameters selected to effect reaction of the polyolefin end groups and chlorine to produce a polyolefin reaction product having labile chlorine substituents.

5. The composition of claim 4 wherein the dispersant is derived from an acylating agent prepared by forming a mixture of the labile chlorine containing polyolefin reacted with an α-β-unsaturated compound, said compound comprising α-β-unsaturated acids, anhydrides, derivatives or mixtures thereof and reacting the mixture under time and temperature parameters selected to effect reaction of the polyolefin with the α-β-unsaturated compound to produce a polyolefin substituted reaction product having low chlorine content.

6. The composition of claim 1 wherein one of the hydrocarbyl groups of (C) is an isopropyl group and the other hydrocarbyl group is 4-methyl-2-pentyl or a primary hydrocarbyl group.

7. The composition of claim 1 wherein within (C) the metal is a Group II metal, aluminum, tin, iron, cobalt, lead, molybdenum, manganese, nickel or copper.

8. A method of cleaning a combustion chamber of an internal combustion engine comprising the step of lubricating said engine with a lubricating oil composition of claim 1.

9. A method of reducing the fuel consumption of an internal combustion engine comprising the step of lubricating said engine with a lubricating oil composition of claim 1.

10. A method of reducing nitrogen oxides emissions of an internal combustion engine comprising the step of lubricating said engine with a lubricating oil composition of claim 1.

* * * * *